US011628344B2

(12) United States Patent
Llewellyn

(10) Patent No.: US 11,628,344 B2
(45) Date of Patent: Apr. 18, 2023

(54) FOLDING ROPING PRACTICE DUMMY ASSEMBLIES, SYSTEMS AND METHODS

(71) Applicant: Jeffery T. Llewellyn, Wibaux, MT (US)

(72) Inventor: Jeffery T. Llewellyn, Wibaux, MT (US)

( * ) Notice: Subject to any disclaimer, the term of this patent is extended or adjusted under 35 U.S.C. 154(b) by 286 days.

(21) Appl. No.: 16/865,885

(22) Filed: May 4, 2020

(65) Prior Publication Data

US 2020/0360787 A1 Nov. 19, 2020

Related U.S. Application Data

(60) Provisional application No. 62/842,998, filed on May 3, 2019.

(51) Int. Cl.
*A63B 69/00* (2006.01)

(52) U.S. Cl.
CPC ..... *A63B 69/0068* (2013.01); *A63B 2210/50* (2013.01); *A63B 2225/74* (2020.08)

(58) Field of Classification Search
CPC .... A63B 69/0068; A01K 15/02; A01M 31/06; A63H 33/003; Y10T 16/5457; A63G 13/06–19/20
See application file for complete search history.

(56) References Cited

U.S. PATENT DOCUMENTS 1,468,979 A * 9/1923 Sherman ..... A01M 31/06 43/3
1,603,114 A * 10/1926 Johnson ..... A01M 31/06 D22/125
2,450,572 A * 10/1948 Ballard ..... A01M 31/06 248/188.91
2,535,445 A * 12/1950 Miller ..... A01M 31/06 43/3
2,714,743 A * 8/1955 Lochner ..... A47B 1/04 108/78
5,286,032 A * 2/1994 Spencer ..... A63B 69/0068 273/339
9,913,456 B2 * 3/2018 McCarthy ..... A01K 15/00
2007/0284377 A1 * 12/2007 Chandler ..... A63B 69/0068 273/338
2009/0014960 A1 * 1/2009 Brackens ..... A63B 69/0068 362/124
2019/0069536 A1 * 3/2019 Davis ..... A01M 31/06

* cited by examiner

*Primary Examiner* — Laura Davison
(74) *Attorney, Agent, or Firm* — Bretton L. Crockett; TechLaw Ventures, PLLC

(57) ABSTRACT

The present disclosure is directed to foldable roping dummy assemblies and systems. In a first illustrative embodiment, a central support portion may have right and left leg assemblies and an upper body chamber generally formed as tube. A body cylinder slidable in the upper body chamber may be connected to a head assembly via a linkage at a front end. In a folded position, the head assembly resides between the leg assemblies. As the head assembly is lifted into position, the body cylinder slides rearward and the linkage rotates the head assembly into position at the front of the upper body chamber. In a second illustrative embodiment, the central support portion may be formed as a set of stairs which includes a central cavity open on at least one side, such that in a folded position, the head assembly resides in the central cavity.

15 Claims, 7 Drawing Sheets

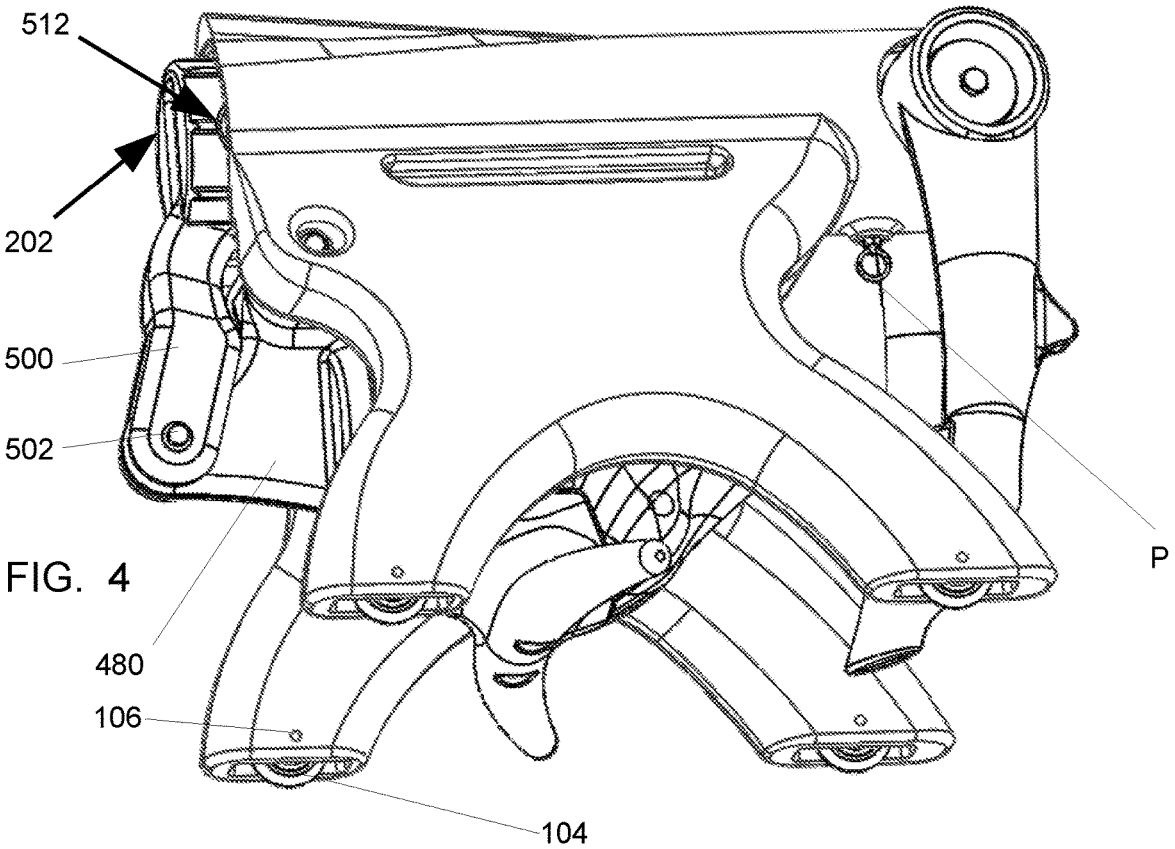
FIG. 4
FIG. 5
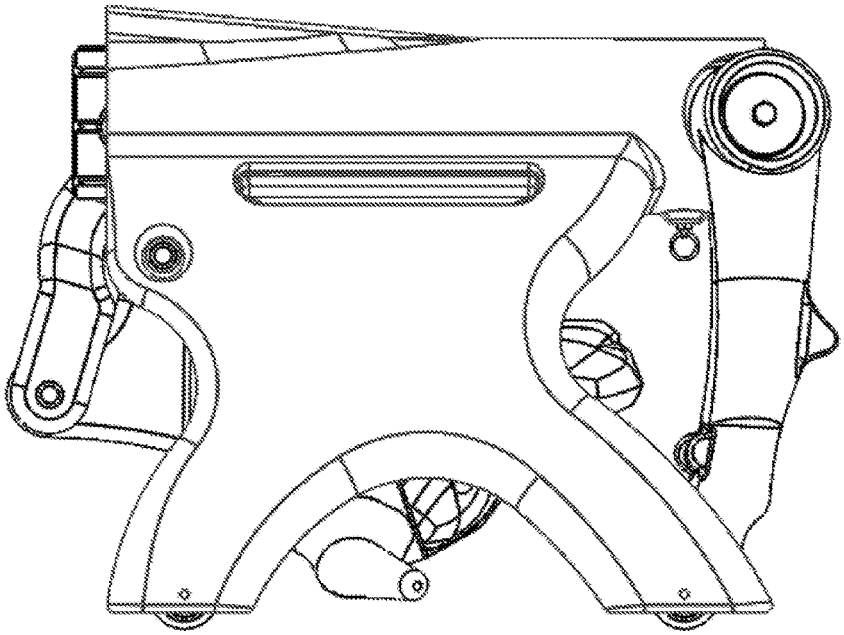

FIG. 6
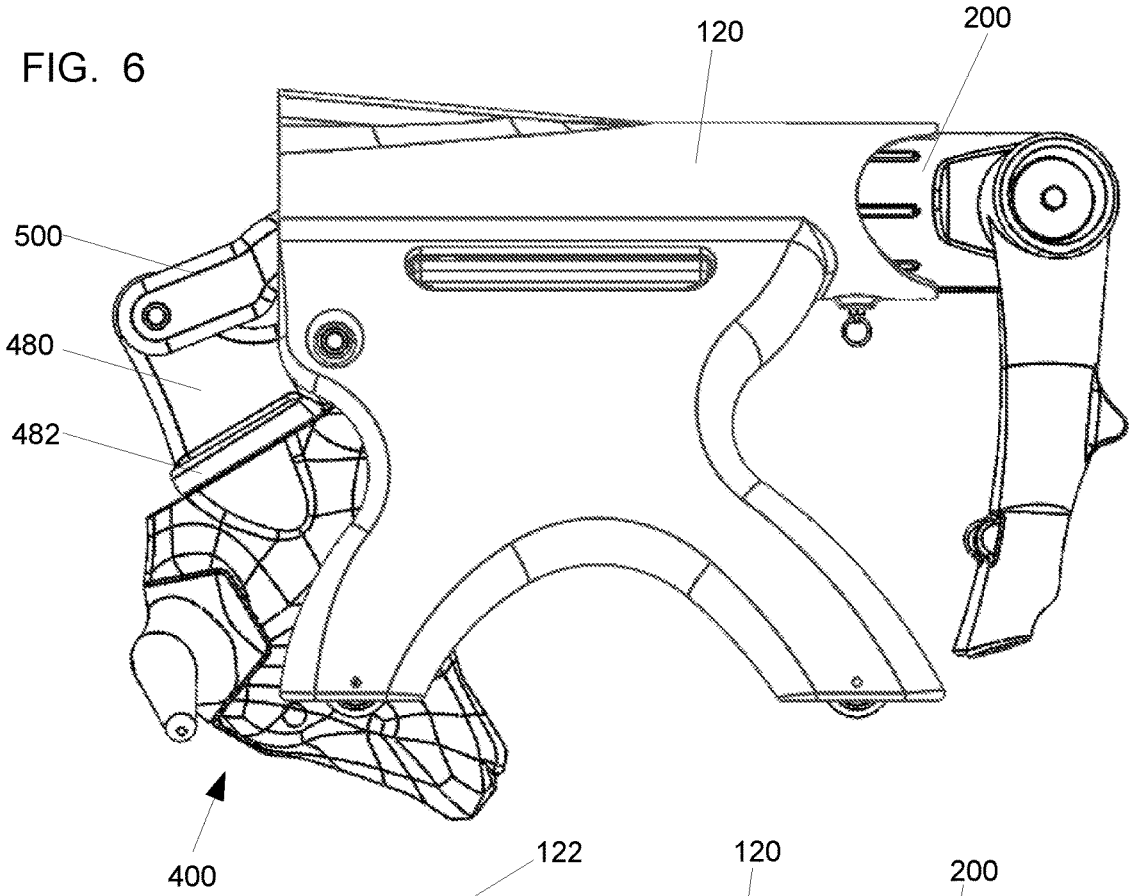
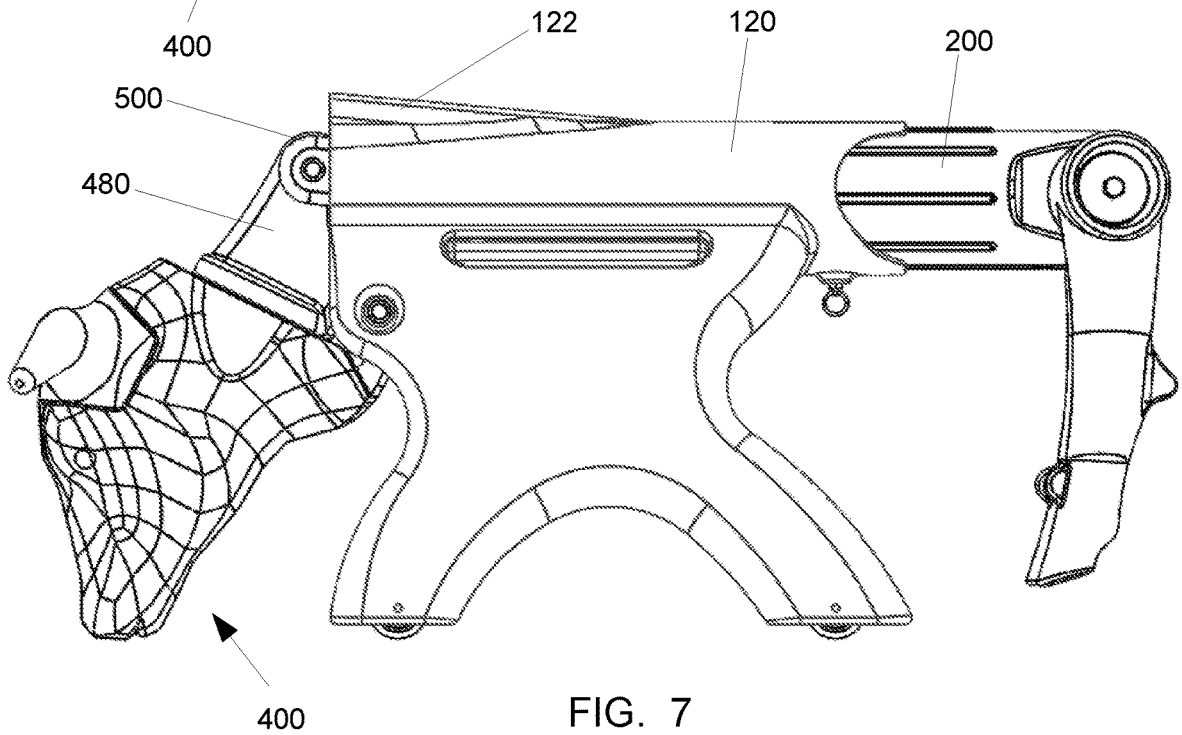
FIG. 7

FIG. 8
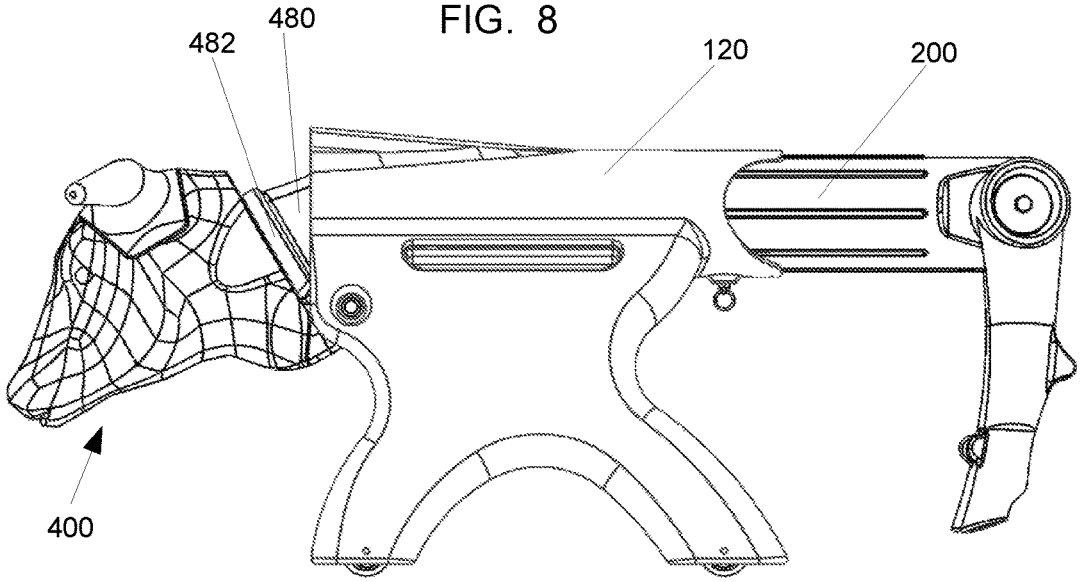
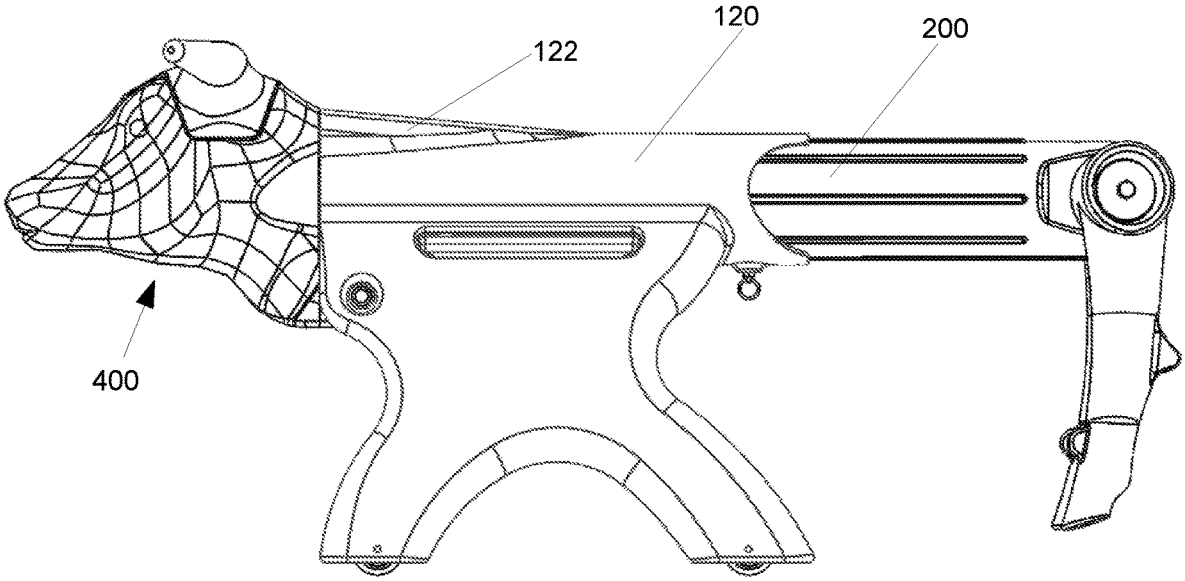
FIG. 9

FIG. 10A
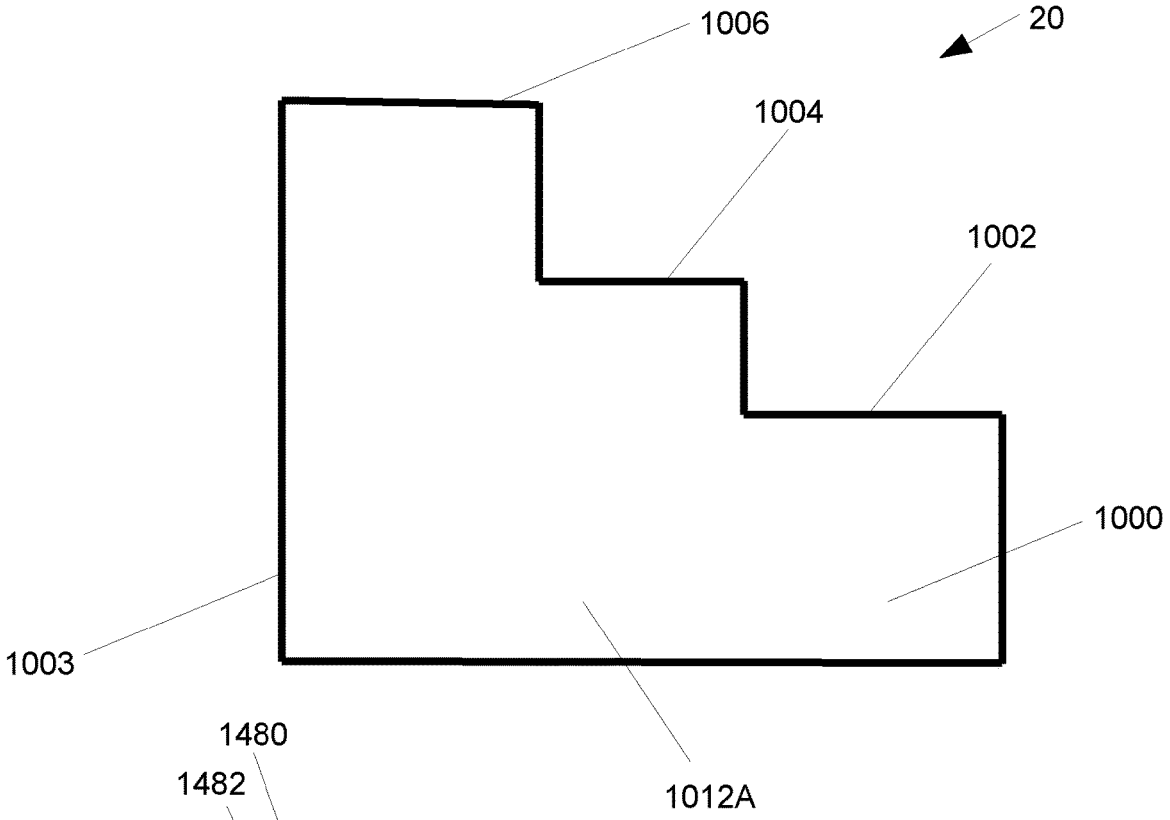
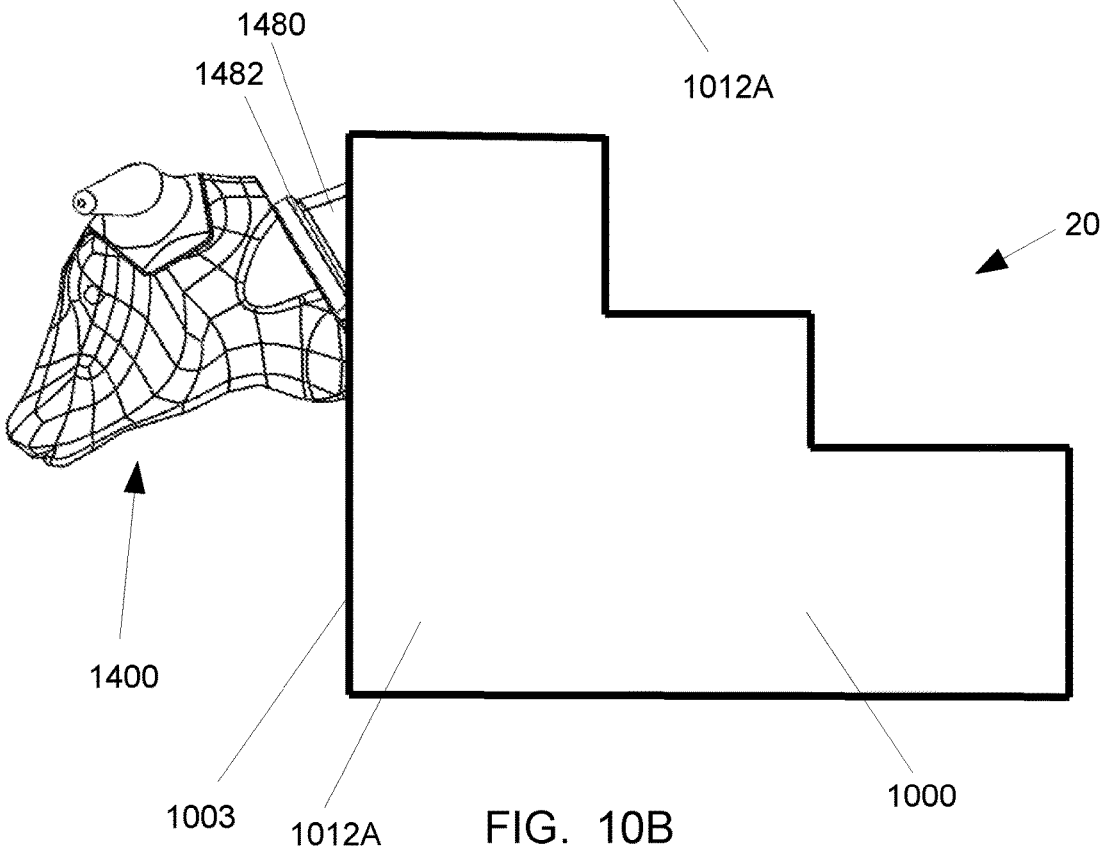
FIG. 10B

FOLDING ROPING PRACTICE DUMMY ASSEMBLIES, SYSTEMS AND METHODS

CROSS-REFERENCE TO RELATED APPLICATION

This application claims the benefit of U.S. Provisional Application No. 62/842,998, filed May 3, 2019, which is incorporated herein by reference in its entirety, including but not limited to those portions that specifically appear hereinafter.

BACKGROUND

Training for rodeo roping events is often done using practice targets that stand in for live animals present during competition. These targets are typically dummies that are sized and shaped to roughly resemble the animals present in the events, such as calves. They also must be robust enough to stand up to the wear generated by repeated roping and use. As a result, they are often heavy duty, bulky objects that are not easily portable. An improved roping dummy that was able to take up less room for storage and transport while able to provide a more enjoyable and/or thorough training experience would be an improvement in the art.

SUMMARY

The present disclosure is directed to foldable roping dummy assemblies and systems. In a first illustrative embodiment, a central support portion may have right, and left leg assemblies and an upper body chamber generally formed as tube. A body cylinder that is slidable in the upper body chamber may be connected to a head assembly via a linkage at a front end and have movable hind target legs attached near a rear end. In a folded position, the head assembly resides between the right and left leg assemblies with the body cylinder in the upper body chamber. As the head assembly is lifted into position, the body cylinder slides rearward and the linkage rotates the head assembly into position at the front of the upper body chamber. The hind target legs may be rotatably attached using a torsion system to provide appropriate limited rearward motion for practicing tying.

In a second illustrative embodiment, a central support portion may be formed as a set of stairs useful for mounting a horse, which includes a central cavity open on at least one side of the body. A head assembly is connected via a linkage, such that in a folded position, the head assembly resides in the central cavity. As the head assembly is lifted into roping position, the linkage rotates the head assembly into position at an upper portion of the side of the body.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

FIG. 4 is a bottom side perspective of the embodiment of FIGS. 1 through 3 in a folded storage arrangement.

FIGS. 5, 6, 7, 8, and 9 are side views which sequentially depict the movement of the embodiment of FIGS. 1 through 4 from a folded storage arrangement to an unfolded deployed arrangement.

FIGS. 10A, 10B, and 10C are side views which sequentially depict the movement of a second illustrative embodiments of a foldable roping dummy assembly from a folded storage arrangement to an unfolded deployed arrangement.

DETAILED DESCRIPTION

A detailed description of systems and methods consistent with embodiments of the present disclosure is provided below. While several embodiments are described, it should be understood that this disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments may be practiced without some or all of these details. Moreover, for the purpose of clarity, certain technical material that is known in the related art has not been described in detail in order to avoid unnecessarily obscuring the disclosure.

Turning to FIGS. 1 through 9, a first illustrative embodiment of a foldable roping dummy assembly or system 10 in accordance with the teachings of the present disclosure is depicted. A central support portion 100 may have left and right counterpart leg assemblies 102A and 102B, which are joined at top portion by an upper body chamber 120 generally formed as tube.

Figure 1:
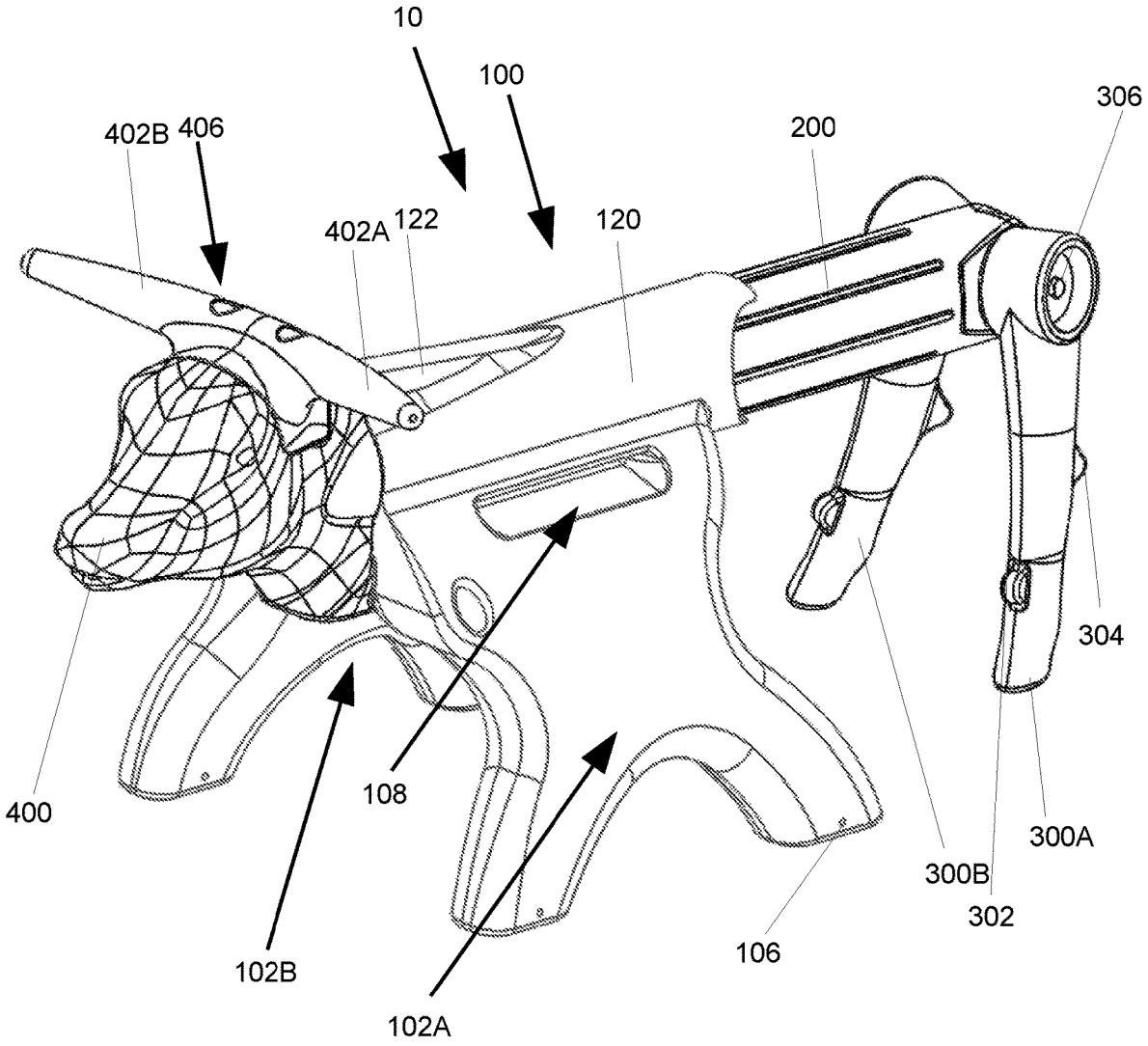
FIGS. 1, 2 and 3 are front perspective, rear perspective, and front views, respectively, of a first illustrative embodiment of a foldable roping dummy assembly in accordance with the teaching of the present disclosure, in a deployed arrangement for use.
Figure 2:
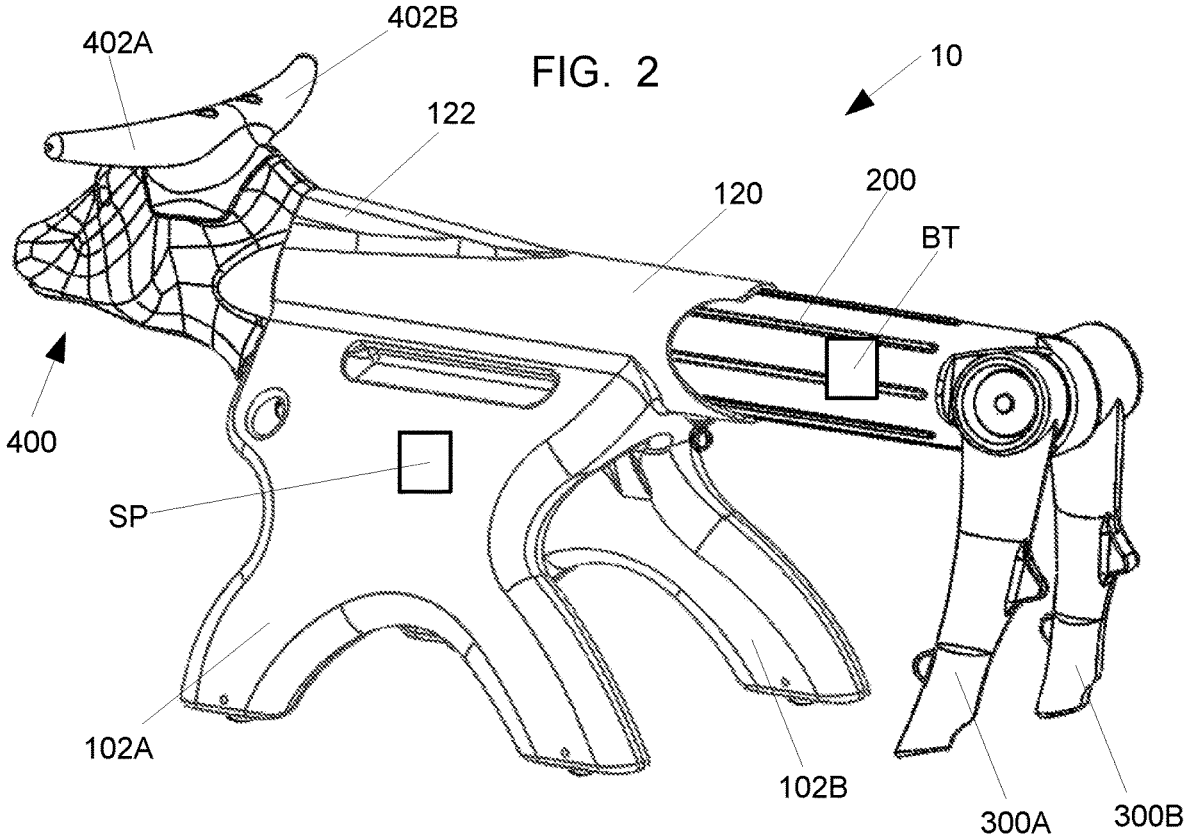
Figure 3:
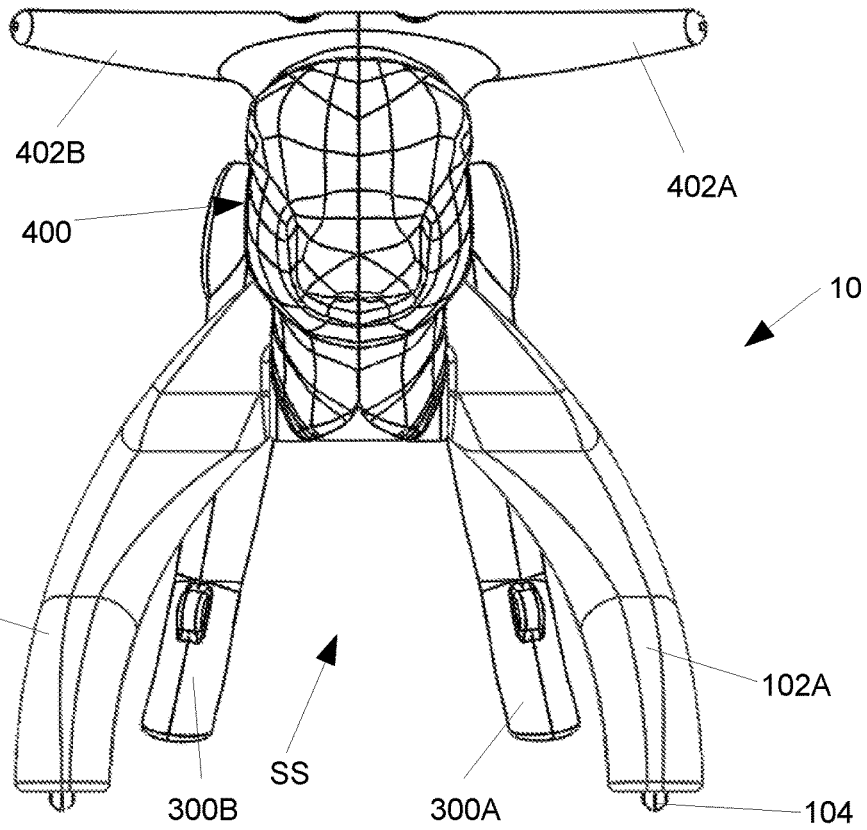

As depicted the counterpart leg assemblies may each extend outwards and downwards from the upper body chamber in a symmetrical manner to define a space SS there between, best depicted in FIG. 3. Along a bottom surface of each leg assemblies, a number of wheels 104 (FIG. 4) may be present to allow the deployed dummy 10 to move on the wheels during practice. As depicted, the wheels may be attached by axles 106 and may partially reside in recesses. The leg assemblies 102A and 102B may be formed with an arced or other shape for design purposes and may include one or more handles 108 formed therein for ease in handling the assembly 10. It will be appreciated that the particular shape may vary in different embodiments.

The upper body chamber 120 may be generally formed with a tubular bore that extends lengthwise to open front and back ends. A recessed seat may be formed as flange in the open front end. As depicted, the upper body chamber may include external features, such as the expanded neck 122 portion that increases its diameter by varied thickness to better mimic the shape of an animal to enhance training.

Body cylinder 200 may be formed as an elongated cylindrical member that is slidably disposed in the upper body chamber 120. At a front end, the body cylinder 120 may be connected to a head assembly 400 via a linkage 500.

Head assembly 400 may include a front portion that is formed to resemble the head of an animal that is roped in a rodeo event, such as a calf. On a top portion of the head assembly 400 two horn sections 402A and 402B may be disposed. These can both mimic the appearance of the animal and provide a target for roping. In the depicted illustrative embodiment, these can attach to the head using bolts that are accessed at bolt head recesses 406. This allows different conformations to be used. For example, the horns can be removed, can be replaced by differently sized or shaped horns, or by assemblies that resemble the ears of an animal. This allows for variation in training and adaptation to different training types for various events.

As depicted, in FIGS. 4-9, at a rear surface an attachment portion 480 may be formed as a member that extends laterally from a rear surface of the head. In the depicted illustrative embodiment, the attachment portion 480 may extend from a base 482 formed as a rounded step on the rear surface. Linkage 500 may be formed as an elongated member that is hingedly attached near a first end to the rear attachment portion 480 by a hinge pin 502. A slot 202 (FIG. 4) may be formed in the front end and partially into the lower side of the body cylinder 200, and the second or rear end of linkage 500 may be hingedly attached to the body cylinder 200 inside the slot 202 by a hinge 512.

In the depicted embodiment, the linkage 500 includes an inset curve in the bottom portion for clearance during deployment. It will be appreciated that this shape may not be needed, and the exact shape of the linkage 500 can vary based on the clearance needed for various embodiments.

Near the rear end of body cylinder 200, two movable hind target legs 300A and 300B may attached. As depicted, these may generally extend from opposite side surfaces of the cylinder. The hind target legs may be formed to resemble the legs of the animal of interest of practice and may include features to help retain a rope during practice, such as the protrusions 302 and 304 depicted as disposed on the front and rear surfaces. The hind legs 300A and 300B may be sized such that do not extend to the ground during use and may be rotatably attached using a torsion system to provide appropriate limited rearward motion for practicing tying. For example, in the depicted illustrative embodiment, leg 300A is rotatably attached by a bolt 306 that is attached to torsion spring (not shown) to limit movement of the leg. The leg 300A can be drawn backwards and upwards to practice tying but return to the forward (down) position at a front stop when the rearward force is removed.

As depicted in FIGS. 4 and 5, in a folded storage position, the head assembly 400 resides in space SS between the leg assemblies 102A and 102B with the body cylinder 200 moved to a forward position in the upper body chamber 120. A spring-loaded locking pin assembly P may extend into a recess on a surface of the cylinder 200 to retain the assembly 10 in the folded or storage position.

Generally, for deployment for use, a user may actuate the pin to withdraw from the recess and lift the assembly 10 to raise at least the forward portion of the leg assemblies 102A and 102B to allow rotation of the head assembly 400. As depicted in FIGS. 5 through 9, the head assembly 400 may be lifted into the deployed position, as the body cylinder 200 slides rearward in the upper body chamber 120. The linkage 500 rotates on the hinges as the head assembly moves into position, and attachment portion 480 is drawn into the front opening of the upper body chamber. Where present, the step 482 may contact the recessed flange for reinforced securement in the deployed unfolded position. The spring-loaded locking pin P may be secured in a second recess to lock the assembly 10 in the deployed position.

It will be appreciated that the assembly may include additional features to make practice more enjoyable or exciting for a user. For example, a speaker, such as Bluetooth speaker (schematically shown as BT in FIG. 2) could be disposed in the assembly, as in the head 400 or cylinder 200 cavities. An associated battery assembly with or without a solar panel (schematically shown as SP in FIG. 2) could be used to provide power to the speaker. Additionally, lights, such as LEDS, could be visible at various locations, such as the tips of the horns, the eye position on head assembly, or positions on the hind legs. Using colored lights could allow for designation of targets for specific games or training exercises.

Turning to FIGS. 10A through 10D, a second illustrative embodiment of a foldable roping dummy assembly or system 20 in accordance with the teachings of the present disclosure is depicted. A central support portion may be formed as a body 1000 which is configured as a set of steps 1002, 1004 and 1006, which allows for use as a mounting step stool. The upper step 1006 may from the upper surface of the body. Body 1000 may have an open bottom, and an open front that allow access to a storage space 1005 between left and right counterpart side members 1012A and 1012B, which are joined at top portions to the upper surface of the body 1000.

Figure 10C:
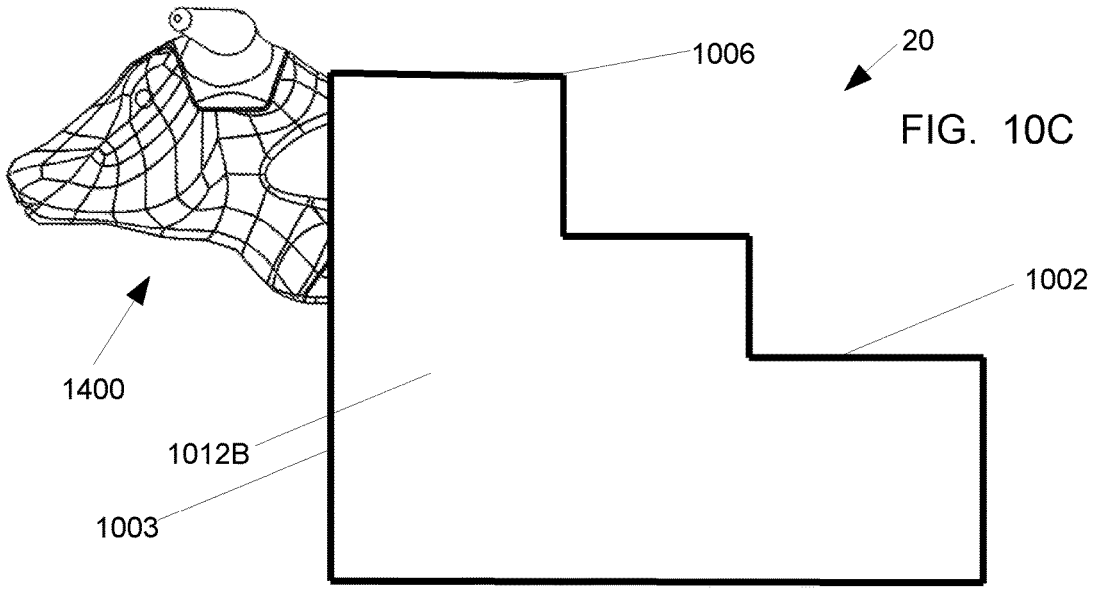
Figure 10D:
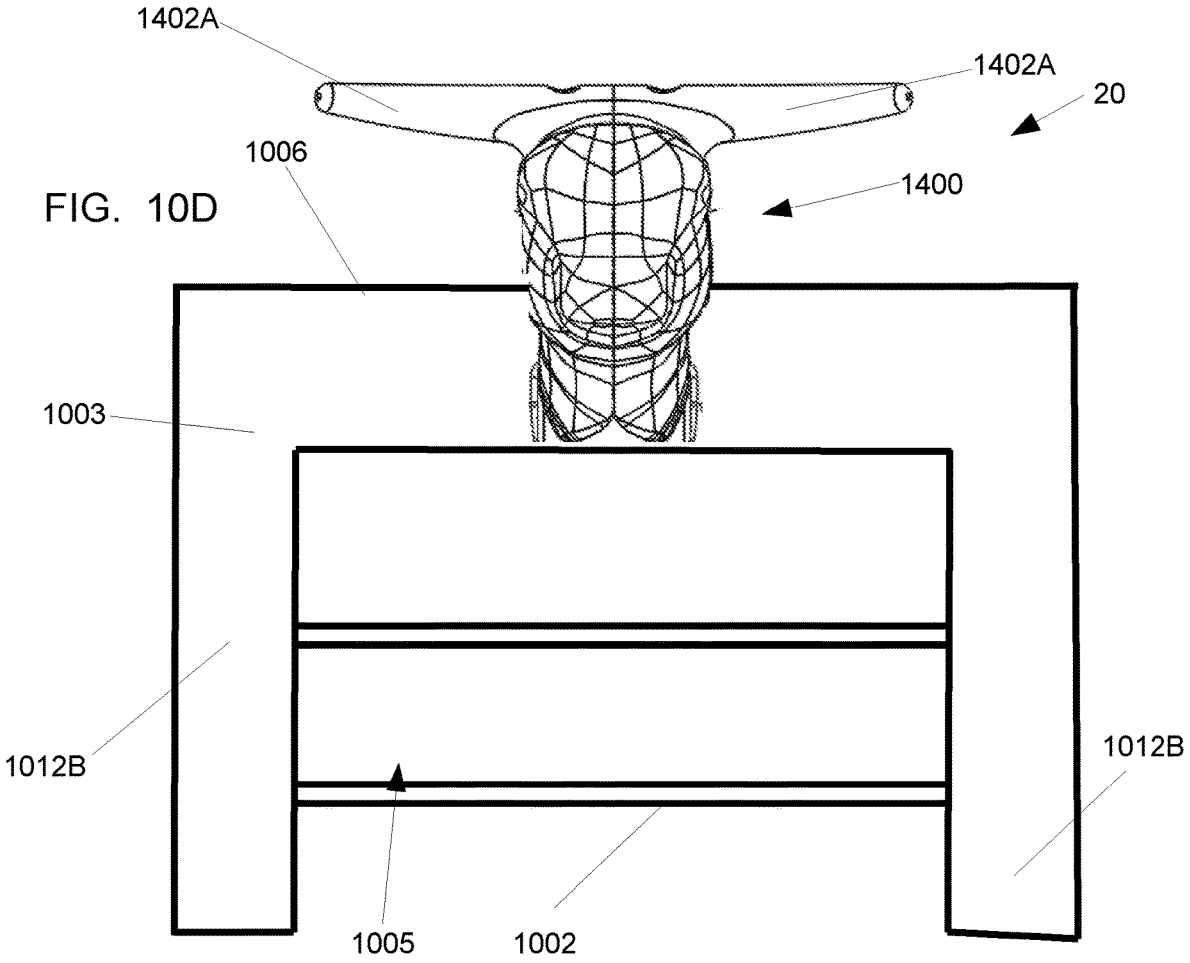
FIG. 10D is a front view of the embodiment of the embodiment of FIGS. 10A, 10B and 10C in an unfolded deployed arrangement.

As depicted, the counterpart side members 1012A and 1012B may each extend downwards in a symmetrical manner to define the sides of storage space 1005, as best depicted in FIG. 10D. It will be appreciated that the particular shape may vary in different embodiments.

Head assembly 1400 is similar to head assembly 400 discussed in connection with FIGS. 1 through 9 and may include a front portion that is formed to resemble the head of an animal that is roped in a rodeo event, such as a calf. On a top portion of the head assembly 1400 two horn sections 1402A and 4102B may be disposed. These can both mimic the appearance of the animal and provide a target for roping. In the depicted illustrative embodiment, these can attach to the head using bolts that are accessed at bolt head recesses to allow different conformations to be used. For example, the horns can be removed, can be replaced by differently sized or shaped horns, or by assemblies that resemble the ears of an animal. This allows for variation in training and adaptation to different training types for various events.

As depicted, in FIG. 10B, head assembly 1400 may include an attachment portion 1480 formed as a member that extends laterally from a rear surface of the head. In the depicted illustrative embodiment, the attachment portion 1480 may extend from a base 1482 formed as a rounded step on the rear surface. As linkage member (not shown) may be hingedly attached to the rear attachment portion 1480 and to a corresponding structure disposed in the body 1000 in the storage space 1005. It will be appreciated that the shape of the linkage and its connection to the body 1000 can vary based on the clearance needed for various embodiments. For example, the linkage could be connected to a cylinder that is slidably mounted with a tube, or to another fixture disposed within the storage space.

As depicted in FIG. 10A, in a folded storage position, the head assembly 1400 resides in the body 1000, within storage space 1005, allowing the assembly 20 to be used as a step stool to assist in mounting a horse or other uses without the head assembly 1400 being exposed.

Generally, for deployment for use, a user may lift the head assembly 1400 from the storage space 1005 to the deployed position. As depicted in FIG. 10B, the head assembly 1400 rotates on the linkage. Where present, the attachment portion 1480 may be drawn into a corresponding seat disposed in the front side 1003 of the body 1000 for reinforced securement in the deployed unfolded position. A securing assembly, such as a spring-loaded locking pin may be used to secure the head assembly in the deployed position. FIGS. 10C and 10D depict system 20 with the head assembly in the deployed position.

The various components may be manufactured from suitable materials for the intended use, which require durability. For example, roto-molding using polymeric materials, such as a suitable polyethylene material, may be used to form components that are then assembled to make the final system or assembly.

Reference throughout this specification to "an example" or an "illustrative embodiment" means that a particular feature, structure, or characteristic described in connection with the example is included in at least one embodiment of the present disclosure. Thus, appearances of these phrases in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present disclosure may be referred to herein along with alternatives for the various components thereof. It is understood that such embodiments, examples, and alternatives are not to be construed as de facto equivalents of one another but are to be considered as separate and autonomous representations of the present disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive.

Those having skill in the art will appreciate that many changes may be made to the details of the above-described embodiments without departing from the underlying principles of the disclosure. The scope of the present disclosure should, therefore, be determined only by the claims.

The invention claimed is:

1. A foldable roping dummy, comprising:

a central support portion comprising an upper body member with a downwards extending right side support member and a downwards extending left side support member which define a storage space underneath the upper body member and between the left side support member and the right side support member, wherein the upper body member comprises an upper body chamber generally formed as a tube;

a head assembly comprising a head portion and a rear attachment portion;

a body cylinder slidable in the tubular upper body chamber; and at least one linkage member, the at least one linkage member pivotally connected near a front end thereof to the rear attachment portion of the head assembly, the at least one linkage member pivotally connected near a rear end thereof to the body cylinder, such that the head assembly can be pivoted between an undeployed storage position within the storage space to a deployed position on a front surface of the central support portion as the body cylinder is slidably deployed in the tubular upper body chamber.

2. The foldable roping dummy of claim 1, wherein the central support portion comprises a body configured as a set of steps.

3. The foldable roping dummy of claim 1, wherein the body cylinder is moved rearward in the body chamber as the head assembly is moved to the deployed position from the undeployed position.

4. The foldable roping dummy of claim 1, wherein the head portion of the head assembly is configured to resemble the head of an animal that is used in competitive rodeo events.

5. The foldable roping dummy of claim 1, further comprising at least one removable horn member attached to the head portion of the head assembly.

6. The foldable roping dummy of claim 1, further comprising at least one lighting assembly disposed in the head assembly for illuminating a portion thereof to designate a target for a user.

7. A foldable roping dummy, comprising:

a central support portion comprising an upper body member with a downwards extending right side support member and a downwards extending left side support member which define a storage space underneath the upper body member and between the left side support member and the right side support member wherein the upper body member comprises a tubular upper body chamber;

a head assembly comprising a head portion and a rear attachment portion;

at least one attachment member which pivotally connects the rear attachment portion of the head assembly to the central support portion, such that the head assembly can be pivoted between an undeployed storage position within the storage space to a deployed position on a front surface of the central support portion;

a body cylinder slidable in the tubular upper body chamber, which is moved rearward in the body chamber as the head assembly is moved to the deployed position; and a left movable target member attached near a rear end of the body cylinder and a right movable target member attached near a rear end of the body cylinder, wherein each of the left movable target member and the right movable target member are pivotally attached to the body cylinder.

8. The foldable roping dummy of claim 7, wherein each of the left movable target member and the right movable target member are configured to resemble the hind legs of an animal.

9. A foldable roping target assembly, comprising:

a central body having an upper surface and a defined storage space accessible through at least a front surface of the body, wherein the body includes a tubular chamber which extends rearwards from the front surface of the body;

a head assembly comprising a head portion and a rear attachment portion;

at least one linkage member which is pivotally connected to the rear attachment portion of the head assembly to thereby allow the head assembly to be pivoted between an undeployed storage position within the storage space and a deployed position on the front surface of the body; and a body cylinder slidable in the tubular chamber, which is moved rearward in the tubular chamber as the head assembly is moved to the deployed position, wherein the at least one linkage member is pivotally connected to the body cylinder.

10. The foldable roping target assembly of claim 9, wherein the body is configured as a set of steps with the upper surface of the body forming the topmost step of the set of steps.

11. The foldable roping target assembly of claim 9, wherein the body is configured to resemble the body of an animal with the upper surface of the body forming a back of the animal, and a downwards extending right side support member and a downwards extending left side support member each resembling the legs of an animal with the storage space accessible therebetween.

12. The foldable roping target assembly of claim 9, further comprising a left movable target member attached near a rear end of the body cylinder and a right movable target member and the right movable target member are pivotally attached to the body cylinder.

13. The foldable roping target assembly of claim 12, wherein each of the left movable target member and the right movable target member are configured to resemble the hind legs of an animal.

14. The foldable roping target assembly of claim 9, further comprising at least one removable horn member attached to the head portion of the head assembly.

15. The foldable roping target assembly of claim 9, further comprising at least one lighting assembly disposed in the head assembly for illuminating a portion thereof to designate a target for a user.

* * * * *